US010578348B2

(12) United States Patent
Zha

(10) Patent No.: US 10,578,348 B2
(45) Date of Patent: Mar. 3, 2020

(54) SYSTEM AND METHOD FOR REDUCING MOISTURE IN A REFRIGERATED ROOM

(71) Applicant: Heatcraft Refrigeration Products LLC, Stone Mountain, GA (US)

(72) Inventor: Shitong Zha, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 43 days.

(21) Appl. No.: 15/408,708

(22) Filed: Jan. 18, 2017

(65) Prior Publication Data

US 2018/0202702 A1 Jul. 19, 2018

(51) Int. Cl.

| | |
|---|---|
| ***F25D 17/04*** | (2006.01) |
| ***F25D 17/00*** | (2006.01) |
| ***F25D 13/00*** | (2006.01) |
| ***F24F 3/14*** | (2006.01) |
| *F25D 21/04* | (2006.01) |

(52) U.S. Cl.

CPC ..... *F25D 17/042* (2013.01); *F24F 3/1423* (2013.01); *F25D 13/00* (2013.01); *F25D 17/005* (2013.01); *F24F 2003/1464* (2013.01); *F24F 2203/1016* (2013.01); *F24F 2203/1032* (2013.01); *F25B 2400/22* (2013.01); *F25D 21/04* (2013.01); *F25D 2317/0411* (2013.01); *F25D 2317/04111* (2013.01)

(58) Field of Classification Search

CPC ..... F25D 17/042; F25D 17/005; F25D 13/00; F25D 2317/04111; F25D 2317/0411; F25D 21/04; F24F 3/1423; F24F 2003/1464; F24F 2003/1016; F24F 2003/1032; F25B 2400/22; F25F 2203/1056; F25F 2203/1068; A47F 3/001

USPC ..... 62/92, 93

See application file for complete search history.

(56) References Cited

U.S. PATENT DOCUMENTS 4,887,438 A * 12/1989 Meckler ..... F24D 5/12 62/271
4,926,618 A * 5/1990 Ratliff ..... B01D 53/06 95/10
5,170,633 A * 12/1992 Kaplan ..... F24F 3/1423 62/271
5,251,458 A * 10/1993 Tchernev ..... B01D 46/00 62/271

(Continued)

FOREIGN PATENT DOCUMENTS

JP 2006038293 2/2006

OTHER PUBLICATIONS

Shitong Zha, Yitai Ma, and Jinggang Wang, "A combination of radiant ceiling panels and CO2 transcritical cycle," Proceeding of International Conference on Energy and the Environment, Shanghai, 2003, 5 pages (Abstract only in English).

(Continued)

*Primary Examiner* — Frantz F Jules
*Assistant Examiner* — Martha Tadesse
(74) *Attorney, Agent, or Firm* — Baker Botts L.L.P.

(57) ABSTRACT

A method includes receiving moisturized air from a refrigerated room and absorbing, in a portion of a desiccant wheel, moisture from the moisturized air, wherein absorbing moisture from the moisturized air produces dehumidified air. The method further includes discharging the dehumidified air to the refrigerated room.

14 Claims, 3 Drawing Sheets

(56) References Cited

U.S. PATENT DOCUMENTS 5,325,676 A * 7/1994 Meckler ..... F24F 3/06 62/271
5,373,704 A * 12/1994 McFadden ..... B01D 53/06 62/271
5,579,647 A * 12/1996 Calton ..... F24F 3/1411 62/223
5,758,511 A * 6/1998 Yoho ..... F24F 3/1411 62/271
6,029,467 A * 2/2000 Moratalla ..... B01D 53/265 165/8
6,083,300 A * 7/2000 McFadden ..... F24F 3/1411 95/113
6,141,979 A * 11/2000 Dunlap ..... F24F 3/044 165/8
6,155,060 A * 12/2000 Parkman ..... A47F 3/001 62/271
6,935,131 B1 * 8/2005 Backman ..... F24F 3/1423 62/235
2004/0134211 A1 * 7/2004 Lee ..... F24F 3/1423 62/271
2004/0244398 A1 * 12/2004 Radermacher ..... B01D 5/0039 62/285
2005/0167080 A1 * 8/2005 Yoho, Sr. ..... F24F 3/08 165/48.1
2005/0262862 A1 * 12/2005 Moffitt ..... F24F 3/1423 62/271
2006/0080994 A1 * 4/2006 Seiden ..... F25D 11/02 62/441
2006/0201183 A1 * 9/2006 Otake ..... F24F 3/1423 62/271
2007/0163279 A1 * 7/2007 Moffitt ..... F24F 3/1423 62/271
2010/0212345 A1 * 8/2010 Yoon ..... F24F 3/1423 62/271
2013/0186118 A1 * 7/2013 Ohs ..... F24F 3/153 62/94

OTHER PUBLICATIONS

Yefeng Liu, Eckhard A. Groll, Kazuaki Yazawa, and Orkan Kurtulus, "Energy Consumption and Feasibility Study of a Hybrid Desiccant Dehumidification Air Conditioning System," 12th IIR Gustav Lorentzen Natural Working Fluids Conference, Edinburgh, 2016, 9 pages.
Extended European Search Report in EP Application No. 18152143.6-1008, dated May 17, 2018, 7 pages.

* cited by examiner

SYSTEM AND METHOD FOR REDUCING MOISTURE IN A REFRIGERATED ROOM

TECHNICAL FIELD

This disclosure relates generally to a refrigerated room. More specifically, this disclosure relates to a system and method of reducing moisture in a refrigerated room.

BACKGROUND

Generally, the temperature within a refrigerated room such as a walk-in freezer or walk-in cooler is maintained in part by one or more heat exchanger coils in the refrigerated room. The heat exchanger coils are configured to absorb heat from the refrigerated room and transfer the heat to refrigerant circulating through the heat exchanger coils. Over time however, moisture within the refrigerated room may accumulate on or around the heat exchanger coils thereby reducing the capability of the coils to transfer heat.

SUMMARY OF THE DISCLOSURE

According to one embodiment, a system includes a desiccant wheel, a motor, a fan, and a heat exchanger. The desiccant wheel is configured to absorb, in a portion of the desiccant wheel, moisture from moisturized air received from a refrigerated room, wherein absorbing the moisture from the moisturized air produces dehumidified air. The motor is configured to continually turn the desiccant wheel when in operation and the fan is configured to bring in outdoor air. The heat exchanger is configured to heat the outdoor air using waste heat from a transcritical refrigeration system and dry the portion of the desiccant wheel using the heated outdoor air. The system is operable to discharge the dehumidified air to the refrigerated room, thereby dehumidifying one or more heat exchanger coils in the refrigerated room.

According to another embodiment, a method includes receiving moisturized air from a refrigerated room and absorbing, in a portion of a desiccant wheel, moisture from the moisturized air, wherein absorbing moisture from the moisturized air produces dehumidified air. The method further includes discharging the dehumidified air to the refrigerated room.

According to yet another embodiment, a controller for a refrigeration system is configured to operate a motor configured to turn a desiccant wheel, wherein the desiccant wheel is configured to absorb, in a portion of the desiccant wheel, moisture from moisturized air received from a refrigerated room, wherein absorbing the moisture from the moisturized air produces dehumidified air that is discharged to the refrigerated room.

Certain embodiments may provide one or more technical advantages. For example, an embodiment of the present disclosure may result in more efficient heat transfer of coils in a refrigerated room. As another example, an embodiment of the present invention may reduce the time required to defrost coils in a refrigerated room. As yet another example, an embodiment of the present disclosure may provide supplemental cooling to refrigerant circulating through the refrigeration system. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
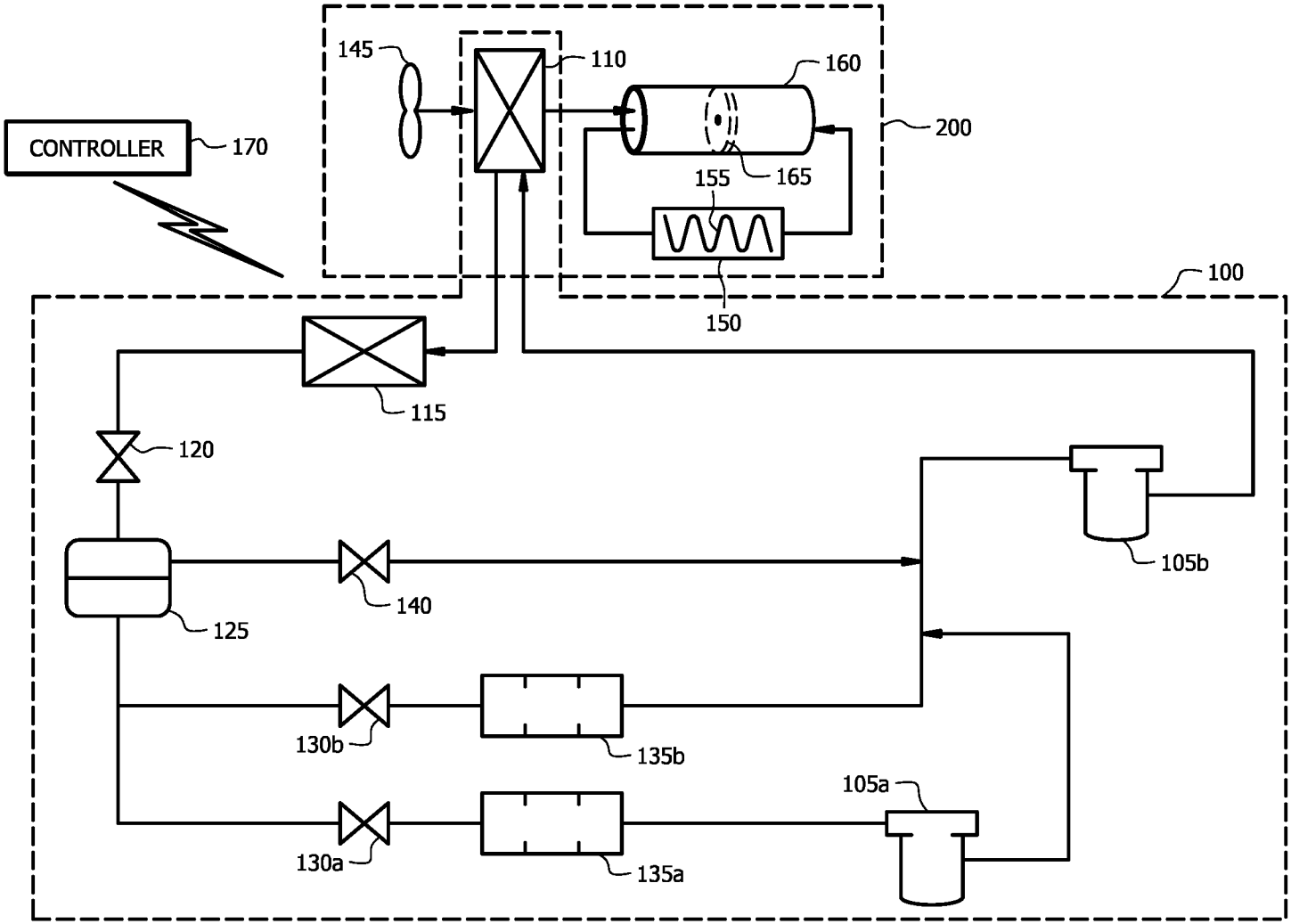
FIG. 1 illustrates an example of a refrigeration system discharging waste heat to a dehumidification system operable to reduce moisture in a refrigerated room, according to certain embodiments.

Embodiments of the present disclosure and its advantages are best understood by referring to FIGS. 1 through 4 of the drawings, like numerals being used for like and corresponding parts of the various drawings.

Moisture is commonly present in refrigerated rooms such as walk-in freezers or walk-in coolers used to store refrigerated food and beverages in grocery stores. Over time, moisture in a refrigerated room results in frost accumulation on or around one or more heat exchanger coils of the refrigerated room. The frost accumulation on or around the heat exchanger coils reduces the ability of the coils to transfer heat efficiently, thereby causing the temperature inside the refrigerated room to increase to undesirable temperatures. Increased temperatures inside a refrigerated room may lead to additional energy consumption and/or food and drink spoilage which may correspond to increased costs. In conventional refrigeration systems, this problem is solved by defrosting (e.g., melting) the coils using electrical energy. Because the coils cannot simultaneously provide heating and cooling, the refrigeration cycle is shut down during a defrost cycle and the refrigeration cycle is restarted once the coils have melted the accumulated frost. In some cases, this cycling occurs multiple times per day. For example, coils in a walk-in freezer may require defrosting six times a day. As another example, coils in a walk-in cooler may require defrosting three times a day. Accordingly, the traditional solution is not energy efficient and is costly. Additionally, the traditional solution may cause undesirable fluctuating in refrigeration and may cause harm to the refrigeration system. This disclosure recognizes a dehumidification system that removes moisture from a refrigerated room and provides dehumidified air to the refrigerated room. As will be explained in further detail below, the disclosed system comprises a desiccant wheel configured to absorb moisture from moisturized air which may be dried by heat reclaimed from a refrigeration system. In doing so, the system reduces the amount of energy and time required to defrost heat exchanger coils relative to conventional refrigeration systems.

As discussed above, in certain embodiments, a dehumidification system may be configured to reclaim waste heat from a refrigeration system in order to perform dehumidification using a desiccant wheel. In certain embodiments, the desiccant wheel may be positioned within a duct above the refrigerated room. The duct may be open on both ends such that a first end is configured to receive outdoor air (e.g., from an outdoor environment) and the second end is configured to direct moisturized heated outdoor air to the outdoor environment. As will be explained in more detail below, the first end of the duct may be configured to receive outdoor air that has been heated using reclaimed waste heat from a refrigeration system. The heated outdoor air may then be directed, within the duct, to dry a moisturized portion of a desiccant wheel. As the heated outdoor air is applied to the moisturized portion of the desiccant wheel, the heated outdoor air passing through the desiccant wheel becomes moisturized (e.g., moisture from the moisturized portion of the wheel is transferred into the heated outdoor air). This moisturized, heated outdoor air is then directed to the outdoor environment. In some embodiments, discharging the moisturized, heated outdoor air yields various benefits over other dehumidification systems. As an example, conventional dehumidification systems may reuse moisturized, heated outdoor air and apply separate processes (which may require additional energy) to dehumidify the moisturized, heated outdoor air. This disclosure recognizes simply removing this air from the duct, thereby eliminating the need for a separate dehumidification step.

FIG. 1 illustrates an example of a refrigeration system 100 interconnected to a dehumidification system 200. As will be disclosed herein, dehumidification system 200 may be operable to use waste heat from refrigeration system 100 to provide dehumidified air to refrigerated room 150. In some embodiments, refrigeration system 100 is a transcritical refrigeration system that circulates a transcritical refrigerant such as $CO_2$. Refrigeration system 100 may include one or more compressors 105, one or more heat exchangers 110, 115, an expansion valve 120, a flash tank 125, one or more valves 130 corresponding to one or more evaporators 135, and a flash tank valve 140. Generally, refrigeration system 100 is operable to provide cold liquid refrigerant to evaporators 135. The evaporators 135 discharge refrigerant vapor to compressors 105 to be compressed into high pressure, hot vapor which is then cooled by one or more heat exchangers 110, 115 and discharged to expansion valve 120 prior to returning to evaporators 135.

Figure 2:
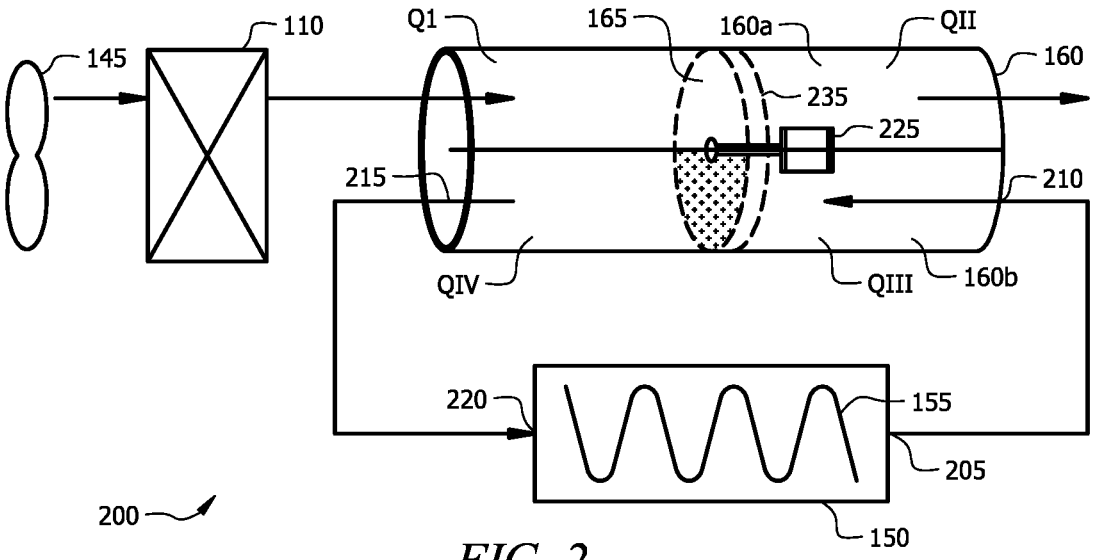
FIG. 2 is an enlarged view of the dehumidification system of FIG. 1, according to certain embodiments.

In addition to being a component of refrigeration system 100, heat exchanger 110 may be a component of dehumidification system 200. In some embodiments, heat exchanger 110 may apply waste heat from refrigeration system 100 to dehumidification system 200, which in turn provides supplemental cooling to refrigerant circulating through refrigeration system 100. As depicted in FIGS. 1 and 2, the waste heat of refrigeration system 100 is used to heat outdoor air directed into heat exchanger 110 by fan 145. The heated air may then be used to dry a desiccant wheel 165 that is configured to absorb moisture from moisturized air supplied from a refrigerated room 150. As a result, dehumidification system may discharge dehumidified air back to refrigerated room 150. In some embodiments, operation of such a system results in one or more of: reduced defrost time of heat exchanger coils (e.g., coils 15) of refrigerated room 150 relative to traditional system, reduced energy consumption relative to traditional systems, and supplemental cooling of refrigerant circulating through refrigeration system 100.

As described above, refrigeration system 100 includes one or more compressors 105. Refrigeration system 100 may include any suitable number of compressors 105. For example, as depicted in FIG. 1, refrigeration system 100 includes two compressors 105*a-b*. Compressors 105 may vary by design and/or by capacity. For example, some compressor designs may be more energy efficient than other compressor designs and some compressors 105 may have modular capacity (i.e., capability to vary capacity). In certain embodiments, compressor 105*a* may be a low-temperature ("LT") compressor that is configured to compress refrigerant discharged from a LT evaporator (e.g., evaporator 135*a*) and compressor 105*b* may be a medium-temperature ("MT") compressor that is configured to compress refrigerant discharged from a MT evaporator (e.g., MT evaporator 135*b*) and provide supplemental compression to refrigerant discharged from compressor 105*a*. Accordingly, compressors 105 may be operable to receive refrigerant discharged from evaporators 135 and compress the received refrigerant. In some embodiments, compressors 105 discharge compressed refrigerant directly to heat exchanger 110. In other embodiments, refrigerant discharged from compressors 105 is directed to another component of refrigeration system 100. In some embodiments, refrigeration system 100 may include a valve (not depicted) configured to be opened and closed based on instructions from a controller (e.g., controller 170 of FIG. 1). In such an embodiment, controller 170 may open and close such valve (e.g., two-way valve or three-way valve) to allow refrigerant to flow directly to one or more of: heat exchanger 115, an oil separator (not depicted), and gas cooler 115.

In some embodiments, refrigeration system 100 comprises one or more heat exchangers. As depicted in FIG. 1, refrigeration system 100 includes two heat exchangers: heat reclaim heat exchanger 110 and gas cooler 115. In some embodiments, heat exchanger 110 and gas cooler 115 are operable to receive refrigerant and apply a cooling stage to the received refrigerant. As an example, heat exchanger 110 may receive refrigerant having a temperature of 120° C. from compressor 105*b*, apply a first cooling stage to the received refrigerant, and discharge the cooled refrigerant having a temperature of 100° C. to gas cooler 115. As another example, gas cooler 110 may receive refrigerant having a temperature of 100° C. from heat exchanger 115, apply a second cooling stage to the received refrigerant, and discharge the cooled refrigerant at a temperature of 40° C. to expansion valve 120. In some embodiments, refrigerant may be cooled between 5° K and 35° K during the first cooling stage and may be cooled between cooled between 40° K and 80° K during the second cooling stage. In addition to performing operations for refrigeration system 100, heat exchanger 110 may also perform operations for dehumidification system 200. For example, heat exchanger 110 may receive outdoor air (e.g., being brought in via fan 145), apply a heating stage to the outdoor air using waste heat of refrigeration system 100, and direct the heated outdoor air to dry a desiccant wheel that absorbs moisture from moisturized air from refrigerated room 150. These functions will be described in more detail below in reference to FIG. 2.

Refrigeration system 100 may also comprise an expansion valve 120. In some embodiments, expansion valve 120 is configured to receive liquid refrigerant from gas cooler 115 and to reduce the pressure of received refrigerant. For example, gas cooler 115 may discharge liquid refrigerant having a pressure of 90 bar to expansion valve 120, and the refrigerant may be discharged from expansion valve 120 having a pressure of 40 bar. In some embodiments, this reduction in pressure causes some of the liquid refrigerant to vaporize. As a result, mixed-state refrigerant (e.g., refrigerant vapor and liquid refrigerant) is discharged from expansion valve 120. In some embodiments, this mixed-state refrigerant is discharged to flash tank 125.

Refrigeration system 100 may include a flash tank 150 in some embodiments. Flash tank 150 may be configured to receive mixed-state refrigerant (e.g., from expansion valve 120) and separate the received refrigerant into flash gas and liquid refrigerant. Typically, the flash gas collects near the top of flash tank 125 and the liquid refrigerant is collected in the bottom of flash tank 125. In some embodiments, the liquid refrigerant flows from flash tank 125 and provides cooling to one or more evaporators (cases) 135 and the flash gas flows to one or more compressors (e.g., compressor 105*b*) for compression before being discharged to heat exchanger 110 and/or gas cooler 115 cooling.

Refrigeration system 100 may include one or more evaporators 135 in some embodiments. As depicted in FIG. 1, refrigeration system 100 includes two evaporators 135*a*, 135*b*. In some embodiments, evaporators 135 are refrigerated cases and/or coolers for storing food and/or beverages that must be kept at particular temperatures. As depicted in FIG. 1, first evaporator 135*a* is a low-temperature case ("LT" case 170*a*) and second evaporator 135*b* is a medium-temperature case ("MT case" 170*b*). LT case 135*a* may be configured to receive liquid refrigerant of a first temperature and MT case 135*b* may be configured to receive liquid refrigerant of a second temperature, wherein the first temperature (e.g., −30° C.) is lower in temperature than the second temperature (e.g., −6° C.). As an example, LT case 135*a* may be a freezer in a grocery store and MT case 170*b* may be a cooler in a grocery store. In some embodiments, the liquid refrigerant leaving flash tank 125 is the same temperature and pressure (e.g., 4° C. and 38 bar) as the refrigerant discharged from expansion valve 120. Before reaching cases 135, the liquid refrigerant may be directed through one or more evaporator valves 130 (e.g., 130*a* and 130*b* of FIG. 1). In some embodiments, each valve 130 may be controlled (e.g., by controller 170 of FIG. 1) to adjust the temperature and pressure of the liquid refrigerant. For example, valve 130*a* may be configured to discharge the liquid refrigerant at −30° C. and 14 bar to LT case 135*a* and valve 130*b* may be configured to discharge the liquid refrigerant at −6° C. and 30 bar to MT case 135*b*. In some embodiments, each evaporator 135 is associated with a particular valve 130 and the valve 130 controls the temperature and pressure of the liquid refrigerant that reaches the evaporator 135.

System 100 may also include a flash gas valve 140 in some embodiments. Flash gas valve 140 may be configured to open and close to permit or restrict the flow through of flash gas discharged from flash tank 125. In some embodiments, controller 170 controls the opening and closing of flash gas valve 140. As depicted in FIG. 1, closing flash gas valve 140 may restrict flash gas from flowing to second compressor 105*b*.

Although this disclosure describes and depicts refrigeration system 100 including certain components, this disclosure recognizes that refrigeration system 100 may include any suitable components. As described above, refrigeration system 100 may include controller 170 operable to communicate with one or more components of refrigeration system 100. For example, controller 170 may be configured to control the operation of valves 120, 130*a*, 130*b*, 140. As was also described above, refrigeration system 100 may include an oil separator (not depicted) operable to separate compressor oil from the refrigerant. As another example, refrigeration system 100 may include one or more sensors configured to detect information about refrigeration system 100 (e.g., temperature and/or pressure information). One of ordinary skill in the art will appreciate that refrigeration system 100 may include other components not mentioned herein.

In addition to controlling operations of one or more components of refrigeration system 100, controller 170 may also be configured to operate components of dehumidification system 200. As an example, controller 170 may be configured to power fan 145 on or off and/or increase or decrease the speed of fan 145. As another example, controller 170 may be configured to operate a motor (e.g., motor 225) configured to turn desiccant wheel 165. As yet another example, controller 170 may be configured to receive information about humidity status within refrigerated room 150 via one or more sensors (not depicted) in refrigerated room 150.

Figure 3:
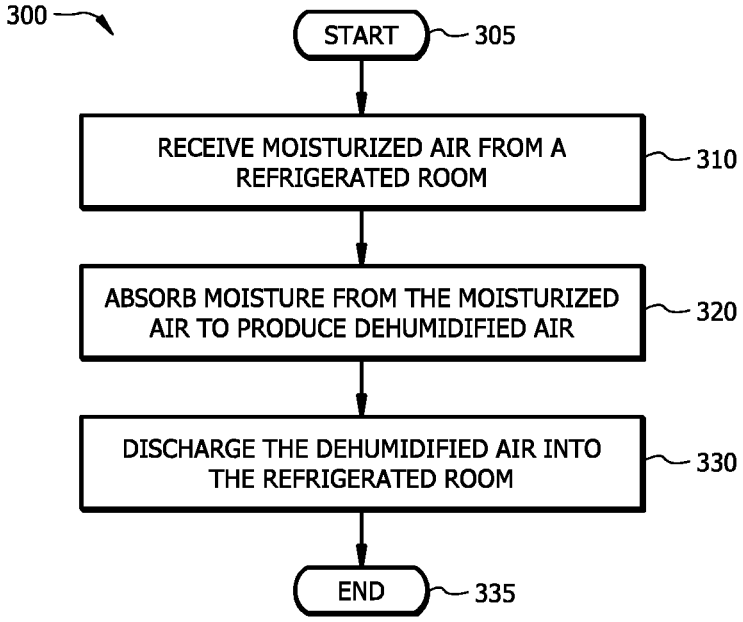
FIG. 3 is a flow chart illustrating a method of operation for the dehumidification system of FIG. 2, according to certain embodiments.
Figure 4:
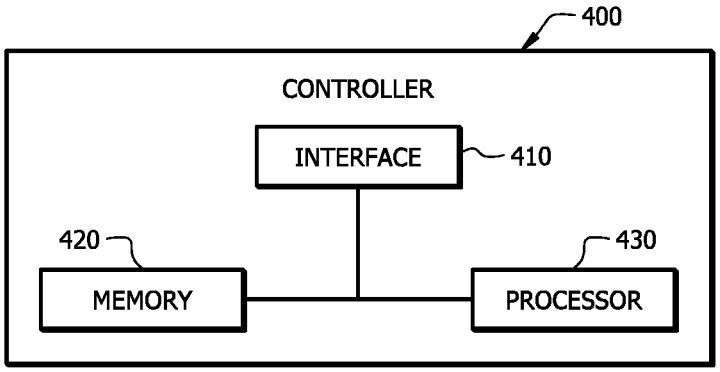
FIG. 4 illustrates an example of a controller for the dehumidification system of FIG. 1, according to certain embodiments.

Generally, FIG. 1 illustrates using waste heat of refrigeration system 100 to facilitate the dehumidification of refrigerated room 150. Specifically, FIG. 1 depicts outdoor air being directed into heat exchanger 110 by fan 145. Heat exchanger 110 uses waste heat of refrigeration system 100 to heat the outdoor air which is then directed through a duct 160 and applied to a moisturized portion of desiccant wheel 165. The heated outdoor air dries the moisturized portion of desiccant wheel 165 and the applied air is then directed to the outdoor environment. This disclosure recognizes that desiccant wheel 165 may be configured to turn (e.g., by motor 225 of FIG. 2) such that the dried portion of desiccant wheel 165 may subsequently absorb moisture from moisturized air directed into duct 160 from refrigerated room 150. FIG. 2 depicts an enlarged schematic of dehumidification system 200 and FIG. 3 illustrates a method 300 of dehumidification system 200 which may reduce moisture in a refrigerated room. Finally, FIG. 4 illustrates a controller configured to execute method 300 in dehumidification system 200. As described above, FIG. 1 illustrates refrigeration system 100 operating in cooperation with dehumidification system 200. Heat exchanger 110 may be a shared component of refrigeration system 100 and dehumidification system 200 and may be configured to perform one or more refrigeration functions and one or more dehumidification functions. For example, heat exchanger 110 may be configured to apply a cooling stage to refrigerant circulating through refrigeration system 100 and apply a heating stage to outdoor air used by dehumidification system 200. As explained above, removing moisture from refrigerated room 150 may be beneficial for a number of reasons. For example, moisture within refrigerated room 150 may freeze on/around heat exchanger coils 155 thereby impeding the ability of coils 155 to transfer heat. As a result, heat that would otherwise be absorbed by coils 155 may persist within refrigerated room 150 and cause the temperature within refrigerated room 150 to increase. In some embodiments, refrigerated room 150 may be a walk-in freezer and/or a walk-in cooler. As an example, refrigerated room 150 may be a walk-in cold room configured to store overstock products within a grocery store. Each refrigerated room 150 may comprise one or more heat exchanger coils 155 configured to transfer heat (e.g., provide cooling to refrigerated room 150 while simultaneously absorbing heat within refrigerated room 150). Coils 155 may, in some embodiments, be located within a duct in/above the ceiling of refrigerated room 150. As depicted in FIGS. 1 and 2, coils 155 are located in a ceiling of refrigerated room 150 and are connected to duct 160. As described above, coils 155 may be obstructed or impeded (e.g., because of frost accumulation) due to moisture within refrigerated room 150. Accordingly, this disclosure recognizes dehumidifying moisturized air within refrigerated room 150 using dehumidification system 200.

As depicted in FIGS. 1 and 2, moisturized air exits refrigerated room 150 via refrigerated room outlet 205 and is directed to duct 160 via inlet 210. The moisturized air may be dehumidified within duct 160 and the dehumidified air is discharged to refrigerated room 150. In some embodiments, the dehumidified air may exit duct 160 via outlet 215 and enter refrigerated room 150 via refrigerated room inlet 220. In this manner, moisture may be removed from refrigerated room 150, thereby decreasing the amount of moisture in refrigerated room 150 which can turn into frost and accumulate on or around coils 155.

Turning now to FIG. 2, dehumidification system 200 comprises fan 145, heat exchanger 110, desiccant wheel 165, and motor 225. As explained above, dehumidification system 200 may reduce moisture in refrigerated room 150 by dehumidifying moisturized air from refrigerated room 150 and supplying refrigerated room 150 with dehumidified air. In some embodiments, desiccant wheel 165 is located within a duct 160 (e.g., duct above the ceiling of refrigerated room 150). Duct 160 may, in some embodiments, comprise a top portion 160*a* and a bottom portion 160*b*. As will be described in further detail below, drying of desiccant wheel 165 may occur in top portion 160*a* and the absorption of moisture by desiccant wheel 165 may occur in bottom portion 160*b*. In some embodiments, desiccant material configured to absorb moisture covers desiccant wheel 165 thereby defining a first surface 230 and a second surface 235. To aid in the following description of dehumidification system 200, reference will be made to quadrants I-IV (QI, QII, QIII, QIV), defined by the configuration of desiccant wheel 165 within duct 160. Reference to QI will refer to the area within top portion 160*a* of duct 160 including first surface 230 of desiccant wheel 165, reference to QII will refer to the area within top portion 160*a* of duct 160 including second surface 235 of desiccant wheel 165, reference to QIII will refer to the area within bottom portion 160*b* of duct 160 including first surface 230 of desiccant wheel 165, and QIV will refer to the area within bottom portion 160*b* of duct 160 including second surface 235 of desiccant wheel 165.

In some embodiments, desiccant wheel 165 is rotated by motor 225. Motor 225 may be controlled by one or more controllers. As an example, motor 225 may be controlled by controller 170. In some embodiments, controller 170 may operate motor, which in turn rotates desiccant wheel 165, based on a humidity of refrigerated room 150. As an example, controller 170 may be configured to operate motor 225 when the humidity in refrigerated room 150 reaches 70%. In some embodiments, the humidity in refrigerated room 150 is determined by one or more sensors in refrigerated room 150. In other embodiments, controller 170 operates motor 225 based on a temperature and/or a power status of refrigerated room 150. For example, controller 170 may operate motor 225 only when refrigerated room 150 is being cooled (e.g., not when refrigerated room 150 is not in operation). Controller 170 may cause motor 225 to turn desiccant wheel 165 continuously or periodically.

As motor 225 turns desiccant wheel 165, different portions of desiccant material may be exposed to one or more of moisturized air from refrigerated room 150 (e.g., in QIII) and heated outdoor air directed into duct 160 by heat exchanger 110 (e.g., in QI). As described above, fan 145 may pull in outdoor air which is heated by heat exchanger 110 using the waste heat of refrigeration system 100. As an example, heat exchanger 110 may apply a heating stage to outdoor air and increase the temperature of outdoor air from 30° C. to 90° C. Heat exchanger 110 may then direct the heated air into QI of duct 160*a* where it is applied to a moisturized portion of desiccant wheel 165 (e.g., portion of desiccant material that absorbed moisture from the moisturized air from refrigerated room 150). In some embodiments, the heated outdoor air is applied to the portion of desiccant wheel in QI (e.g., first surface 230 of desiccant wheel in top portion 160*a* of duct 160). In some embodiments, applying the heated outdoor air to the moisturized portion of desiccant wheel 165 dries the portion of desiccant wheel 165. As a result, the moisture from desiccant wheel 165 passes into the heated outdoor air (e.g., in QII) which is directed to an outdoor environment.

Bottom portion 160*b* of duct 160 may be configured to receive moisturized air from refrigerated room 150 which is then dehumidified and discharged to refrigerated room 150. In some embodiments, moisturized air exits refrigerated room via refrigerated room outlet 205 and enters QIII of duct 160 via inlet 210. Upon entering QIII, the moisturized air contacts second surface 235 of desiccant wheel 165. Accordingly, the portion of desiccant wheel 165 exposed to the moisturized air (e.g., the portion of desiccant wheel 165 in QIII) will absorb moisture from the moisturized air, thereby producing dehumidified air that passes through first surface 230 of desiccant wheel 165 into QIV of duct 160. The dehumidified air may then be directed out from QIV via outlet 215 to refrigerated room 150 via refrigerated room inlet 220.

The following is a description of a cycle of operation for dehumidifying refrigerated room 150 using the system described above. In operation, moisturized air from refrigerated room 150 is directed to QIII where it contacts a first surface of a portion of desiccant wheel 165. The portion of desiccant material absorbs moisture from the moisturized air, thereby producing dehumidified air, and the dehumidified air passes through the second surface of the portion of desiccant wheel 165 (e.g., into QIV) and is directed to refrigerated room 150. In some embodiments, the moisturized air exits refrigerated room 150 through refrigerated room outlet 205 and enters the duct through an inlet (e.g., inlet 210). In some embodiments, the dehumidified air exits duct 160 through an outlet (e.g., outlet 215) and enters refrigerated room 150 via refrigerated room inlet 220. In some embodiments, desiccant wheel 165 is continuously turned by motor 225 such that the portion of desiccant wheel 165 that absorbed the moisture is exposed to outdoor air that has been heated by waste heat from refrigeration system 100 by heat exchanger 110. The heated outdoor air may be applied to the portion of desiccant wheel 165 that absorbed the moisture, thereby drying the portion of desiccant wheel 165 and forcing the moisture into air that is discharged to the outdoor environment. The now-dried portion of desiccant wheel 165 may subsequently be exposed to moisturized air (e.g., by turning desiccant wheel 165 with motor 225) from refrigerated room 150 and the process can begin anew.

FIG. 3 illustrates a method of operation for dehumidification system 200. In some embodiments, the method 300 may be implemented by a controller of dehumidification system 200 (e.g., controller 170 of FIG. 1). Method 300 may be stored on a computer readable medium, such as a memory of controller 170 (e.g., memory 420 of FIG. 4), as a series of operating instructions that direct the operation of a processor (e.g., processor 430 of FIG. 4). Method 300 may be associated with efficiency benefits such as reduced power consumption relative to conventional methods of defrosting heat exchange coils 155 of a refrigerated room 150. In some embodiments, the method 300 begins in step 305 and continues to step 310.

At step 310, the system 200 receives moisturized air from a refrigerated room 150. As explained above, moisture develops within refrigerated room 150 over time and can lead to frost accumulation on/around coils 155. In some embodiments, the moisturized air is directed out of refrigerated room 150 via refrigerated room outlet 205 and directed into QIII of duct 160 via inlet 210. In some embodiments, the method 300 continues to a step 320.

At step 320, the system 200 absorbs moisture from the moisturized air in a portion of desiccant wheel 165. In some embodiments, the component of system 200 that absorbs moisture from the moisturized air is desiccant wheel 165. As described above, desiccant wheel 165 may be located within duct 160 and may comprise desiccant material configured to absorb moisture. As such, the desiccant material of desiccant wheel 165 in QIII of duct 160 may absorb the moisture from the moisturized air received at step 310. In some embodiments, the moisturized air becomes dehumidified air as it passes through desiccant wheel 165 from QIII to QIV. In some embodiments, the method 300 continues to a step 330.

At step 330, the system 200 discharges the dehumidified air to refrigerated room 150. As explained above, the moisture from the moisturized air is absorbed by the desiccant material of desiccant wheel 165 at step 320, thereby producing dehumidified air. The system 200 may discharge the dehumidified air from QIV to refrigerated room 150 via outlet 215 and refrigerated room inlet 220. In some embodiments, the method 300 continues to an end step 335.

The method 300 may include one or more additional steps in some embodiments. As an example, the method 300 includes steps that may occur in top portion 160*b* of duct 160. Thus, in some embodiments, the method 300 may include one or more of the following steps: bringing in outdoor air from an outdoor environment; heating the outdoor air using waste heat from a transcritical refrigeration system; and drying the portion of the desiccant wheel using the heated outdoor air to produce moisturized outdoor air. In some embodiments, the component of system 200 that brings in outdoor air from an outdoor environment may be fan 145 and the component of system 200 that heats the outdoor air using waste heat from a transcritical refrigeration system may be heat exchanger 110. Although this disclosure describes and depicts certain steps of method 300, this disclosure recognizes that method 400 may comprise any suitable step.

FIG. 4 illustrates an example controller 400 of dehumidification system 200 and/or refrigeration system 100, according to certain embodiments of the present disclosure. In some embodiments, controller 400 may be an example of controller 170 described herein in relation to FIG. 1. Controller 400 may comprise one or more interfaces 410, memory 420, and one or more processors 430. Interface 410 receives input (e.g., sensor data or system data), sends output (e.g., instructions), processes the input and/or output, and/or performs other suitable operation. Interface 410 may comprise hardware and/or software. As an example, interface 410 receives information (e.g., temperature, operation, speed, pressure information) about one or more components of systems 100, 200 (e.g., via sensors).

Memory (or memory unit) 420 stores information. As an example, memory 420 may store method 300. Memory 420 may comprise one or more non-transitory, tangible, computer-readable, and/or computer-executable storage media. Examples of memory 420 include computer memory (for example, Random Access Memory (RAM) or Read Only Memory (ROM)), mass storage media (for example, a hard disk), removable storage media (for example, a Compact Disk (CD) or a Digital Video Disk (DVD)), database and/or network storage (for example, a server), and/or other computer-readable medium.

Processor 430 may include any suitable combination of hardware and software implemented in one or more modules to execute instructions and manipulate data to perform some or all of the described functions of controller 400. In some embodiments, processor 430 may include, for example, one or more computers, one or more central processing units (CPUs), one or more microprocessors, one or more applications, one or more application specific integrated circuits (ASICs), one or more field programmable gate arrays (FPGAs), and/or other logic.

Embodiments of the present disclosure may have one or more technical advantages. In certain embodiments, a heat exchanger downstream the gas cooler provides supplemental cooling to refrigerant, thereby reducing the amount of power of other refrigeration system components configured to cool the refrigerant. Additionally, the waste heat produced by the downstream heat exchanger may be reclaimed by other facility systems (e.g., floor heating system, water heating system), thereby reducing the amount of power of compressors 105.

Although this disclosure describes and depicts a configuration of a transcritical refrigeration system including a heat exchanger downstream from the gas cooler, this disclosure recognizes other similar applications. For example, this disclosure recognizes a configuration of a conventional refrigeration system comprising a heat exchanger downstream from a condenser. The downstream heat exchanger would provide supplemental cooling to refrigerant circulating through the conventional refrigeration system, thereby reducing the power consumption of compressors 105. Additionally, the waste heat produced as a result of operation of the downstream heat exchanger could be reclaimed and used by other facility systems.

This disclosure also recognizes dehydrating food in a similar manner. Taking FIG. 1 as an example, dehumidification system 200 may be configured to remove moisture from a food dehydrator (not depicted) in some embodiments. In such an embodiment, moisturized air within a food dehydrator may be directed to a duct 160 comprising a desiccant wheel 165 configured to absorb moisture from the moisturized air. In doing so, the moisturized air becomes dehumidified air which may then be directed back to food dehydrator. The portion of the desiccant wheel 165 that absorbed the moisture may then be dried using outdoor air heated using waste heat from a refrigeration system (e.g., refrigeration system 100 of FIG. 1). After drying the portion of moisturized portion of the desiccant wheel 165, the dried portion may be re-exposed to moisturized air from the food dehydrator to begin the cycle anew.

Modifications, additions, or omissions may be made to the systems, apparatuses, and methods described herein without departing from the scope of the disclosure. The components of the systems and apparatuses may be integrated or separated. Moreover, the operations of the systems and apparatuses may be performed by more, fewer, or other components. For example, refrigeration system 100 may include any suitable number of compressors, condensers, condenser fans, evaporators, valves, sensors, controllers, and so on, as performance demands dictate. One skilled in the art will also understand that refrigeration system 100 can include other components that are not illustrated but are typically included with refrigeration systems. Additionally, operations of the systems and apparatuses may be performed using any suitable logic comprising software, hardware, and/or other logic. As used in this document, "each" refers to each member of a set or each member of a subset of a set.

Modifications, additions, or omissions may be made to the methods described herein without departing from the scope of the disclosure. The methods may include more, fewer, or other steps. Additionally, steps may be performed in any suitable order.

Although this disclosure has been described in terms of certain embodiments, alterations and permutations of the embodiments will be apparent to those skilled in the art. Accordingly, the above description of the embodiments does not constrain this disclosure. Other changes, substitutions, and alterations are possible without departing from the spirit and scope of this disclosure.

The invention claimed is:

1. A system comprising:

one or more heat exchanger coils of a refrigerated room;

ducting comprising an outdoor air inlet;

a desiccant wheel at least partially disposed within the ducting, wherein the desiccant wheel is configured to:

turn such that a first portion of the desiccant wheel moves from a first position to a second position, wherein the second position is located above the first position;

absorb, when the desiccant wheel is in the first position, moisture from moisturized air of the refrigerated room, wherein absorbing the moisture from the moisturized air produces dehumidified air; and release, when the desiccant wheel is in the second position, the moisture from the moisturized air into heated outdoor air passing through the desiccant wheel; and a motor configured to turn the desiccant wheel during an operation of the system;

a fan configured and disposed within the system to bring in outdoor air through the outdoor air inlet;

a heat exchanger configured and disposed within the system to heat the outdoor air using waste heat from a transcritical refrigeration system to produce heated outdoor air, wherein the heated outdoor air is directed through the desiccant wheel in a manner that dries the first portion of the desiccant wheel; and wherein:

the one or more heat exchanger coils of the refrigerated room are dehumidified by absorbing the moisture from the moisturized air.

2. A system comprising a:

one or more heat exchanger coils of a refrigerated room;

a desiccant wheel at least partially disposed within a duct, the desiccant wheel being configured to:

turn such that a portion of the desiccant wheel, moves from a first position to a second position, wherein the second position is located above the first position;

absorb, when the desiccant wheel is in the first position, moisture from moisturized air of the refrigerated room, wherein absorbing the moisture from the moisturized air produces dehumidified air; and release, when the desiccant wheel is in the second position, the moisture from the moisturized air into heated outdoor air passing through the desiccant wheel; and wherein the one or more heat exchanger coils of the refrigerated room are dehumidified by the dehumidified air.

3. The system of claim 2, further comprising a fan and a heat exchanger, wherein:

the fan is configured to bring in the outdoor air; and the heat exchanger is configured to heat the outdoor air using waste heat from a transcritical refrigeration system.

4. The system of claim 3, wherein the duct further comprises an outdoor air outlet whereby moisturized outdoor air is directed to an outside environment.

5. The system of claim 3, wherein:

the desiccant wheel consists of the first portion and a second portion; and both the first portion and the second portion are disposed within the duct.

6. The system of claim 3, wherein a controller is configured to operate the system.

7. The system of claim 2, wherein a motor of the system is configured to turn the desiccant wheel.

8. The system of claim 2, wherein the refrigerated room is one or more of: a walk-in freezer and a walk-in cooler.

9. The system of claim 3, wherein:

the duct further comprises an outdoor air inlet; and the fan is disposed within the system to bring in the outdoor air through the outdoor air inlet.

10. A method comprising:

absorbing, in a first portion of a desiccant wheel, moisture from moisturized air from a refrigerated room, wherein absorbing the moisture from the moisturized air produces dehumidified air;

bringing in outdoor air from an outdoor environment;

heating the outdoor air using waste heat from a transcritical refrigeration system;

directing, within a duct, heated outdoor air towards the desiccant wheel;

turning the desiccant wheel to expose the first portion of the desiccant wheel to the heated outdoor air;

drying the first portion of the desiccant wheel using the heated outdoor air;

dehumidifying one or more heat exchanger coils of the refrigerated room by discharging the dehumidified air to the refrigerated room; and wherein the first portion of the desiccant wheel is positioned, prior to being rotated, below the duct through which the heated outdoor air is directed.

11. The method of claim 10, further comprising:

turning the desiccant wheel based on one or more of:

a temperature of the refrigerated room;

a humidity of the refrigerated room; or a power status of the refrigerated room.

12. The method of claim 11, further comprising discharging a moisturized outdoor air to an outdoor environment.

13. The method of claim 10, wherein the refrigerated room is one or more of: a walk-in freezer and a walk-in cooler.

14. The method of claim 10, wherein:

the duct comprises a top portion and a bottom portion and the heated outdoor air is directed through the top portion of the duct.

* * * * *